US009344800B2

(12) United States Patent
Adamson

(10) Patent No.: US 9,344,800 B2
(45) Date of Patent: May 17, 2016

(54) LOUDSPEAKER ARRAY ELEMENT

(75) Inventor: Alan Brock Adamson, Greenbank (CA)

(73) Assignee: ADAMSON SYSTEMS ENGINEERING INC., Port Perry, ON (CA)

( * ) Notice: Subject to any disclaimer, the term of this patent is extended or adjusted under 35 U.S.C. 154(b) by 311 days.

(21) Appl. No.: 13/879,369

(22) PCT Filed: Oct. 13, 2011

(86) PCT No.: PCT/CA2011/050645

§ 371 (c)(1),
(2), (4) Date: Jul. 31, 2013

(87) PCT Pub. No.: WO2012/048428

PCT Pub. Date: Apr. 19, 2012

(65) Prior Publication Data

US 2013/0301862 A1 Nov. 14, 2013

Related U.S. Application Data

(60) Provisional application No. 61/392,897, filed on Oct. 13, 2010.

(51) Int. Cl.

| | |
|---|---|
| ***H04R 1/02*** | (2006.01) |
| ***H04R 5/02*** | (2006.01) |
| ***H04R 1/40*** | (2006.01) |
| *H04R 27/00* | (2006.01) |

(52) U.S. Cl.

CPC ..... *H04R 5/02* (2013.01); *H04R 1/025* (2013.01); *H04R 1/403* (2013.01); *H04R 1/026* (2013.01); *H04R 27/00* (2013.01)

(58) Field of Classification Search

CPC ..... H04R 9/022; H04R 3/00; H04M 1/03
See application file for complete search history.

(56) References Cited

U.S. PATENT DOCUMENTS

| | | | | |
|---|---|---|---|---|
| 5,000,286 | A * | 3/1991 | Crawford | H04R 1/02 181/145 |
| 5,533,132 | A * | 7/1996 | Button | H04R 1/028 181/199 |
| 6,460,651 | B1 * | 10/2002 | Sahyoun | H04R 1/2834 181/157 |
| 7,113,607 | B1 * | 9/2006 | Mullins | 381/96 |
| 2002/0071580 | A1 * | 6/2002 | Engebretson | H04R 1/026 381/182 |
| 2003/0002702 | A1 * | 1/2003 | Cox | H04R 1/025 381/340 |
| 2008/0110320 | A1 * | 5/2008 | Boone | G10D 1/005 84/380 R |
| 2010/0322445 | A1 * | 12/2010 | Jakowski | 381/182 |

FOREIGN PATENT DOCUMENTS

| | | | | |
|---|---|---|---|---|
| WO | WO 9903375 | A1 * | 1/1999 | H04R 1/02 |

OTHER PUBLICATIONS

Extended European Search Report for corresponding European Application No. EP 11831897 mailed Feb. 24, 2014.

* cited by examiner

*Primary Examiner* — Duc Nguyen
*Assistant Examiner* — Assad Mohammed
(74) *Attorney, Agent, or Firm* — Lynn C. Schumacher; Stephen W. Leonard; Hill & Schumacher

(57) ABSTRACT

A loudspeaker array element with an internal rigid structural frame and at least one interface for attaching one or more of enclosures, rigging components, waveguides, sound chambers, transducers and electronics to the frame is provided. Further configurations are provided for heat sinking of electrically powered devices such as loudspeakers, as well as power amplifiers, digital signal processing and networking hardware.

27 Claims, 15 Drawing Sheets

| | |
|---|---|
| 10 | Structural module |
| 12 | Rigid frame |
| 14 | Front rigging attachment interfaces |
| 18 | Back rigging attachment interfaces |
| 22 | Enclosure attachment interfaces |
| 26 | Transducer attachment interface |
| 30 | Amplifier attachment interfaces |
| 34 | Cover plate attachment interface |
| 38 | Sound chamber attachment interface |

| | |
|---|---|
| 10 | Structural module |
| 14 | Front rigging attachment interfaces |
| 16 | Front rigging components |
| 18 | Back rigging attachment interfaces |
| 20 | Back rigging components |
| 22 | Enclosure attachment interfaces |
| 26 | Transducer attachment interface |
| 30 | Amplifier attachment interfaces |
| 38 | Sound chamber attachment interface |

| | |
|---|---|
| 10 | Structural module |
| 14 | Front rigging attachment interfaces |
| 16 | Front rigging components |
| 18 | Back rigging attachment interfaces |
| 20 | Back rigging components |

| | |
|---|---|
| 10 | Structural module |
| 38 | Sound chamber attachment interface |
| 40 | Sound chambers |

| | |
|---|---|
| 26 | Transducer attachment interface |
| 28 | Transducer assemblies |
| 29 | Transducer frame |
| 38 | Sound chamber attachment interface |

| | |
|---|---|
| 10 | Structural module |
| 30 | Amplifier attachment interfaces |
| 32 | Amplifier chassis |

| | |
|---|---|
| 10 | Structural module |
| 30 | Amplifier attachment interfaces |
| 32 | Amplifier chassis |

| | |
|---|---|
| 10 | Structural module |
| 22 | Enclosure attachment interfaces |
| 24 | Enclosures |

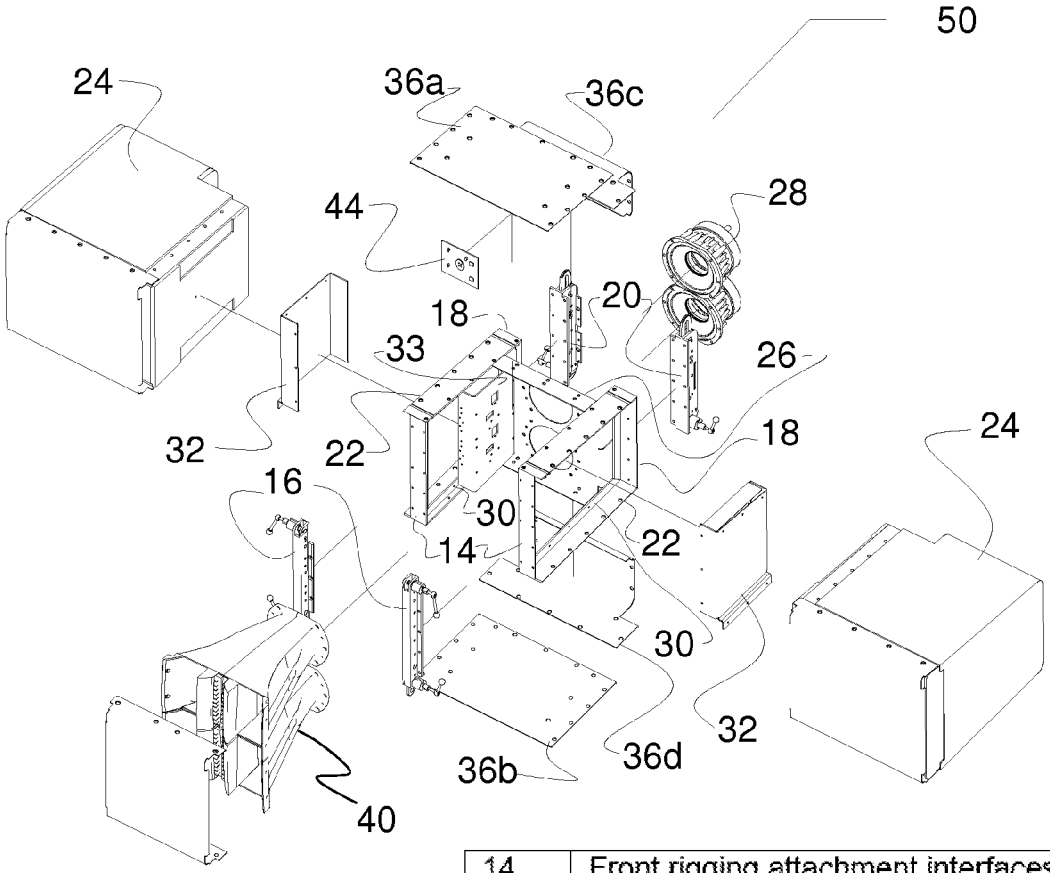

Fig. 9

| | |
|---|---|
| 14 | Front rigging attachment interfaces |
| 16 | Front rigging components |
| 18 | Back rigging attachment interfaces |
| 20 | Back rigging components |
| 22 | Enclosure attachment interfaces |
| 24 | Enclosures |
| 26 | Transducer attachment interface |
| 28 | Transducer assemblies |
| 30 | Amplifier attachment interfaces |
| 32 | Amplifier chassis |
| 33 | Amplifier cover |
| 36a | Top cover |
| 36b | Bottom cover |
| 36c,d | Back covers |
| 40 | Sound chambers |
| 44 | Electronic interface |
| 50 | Array element |

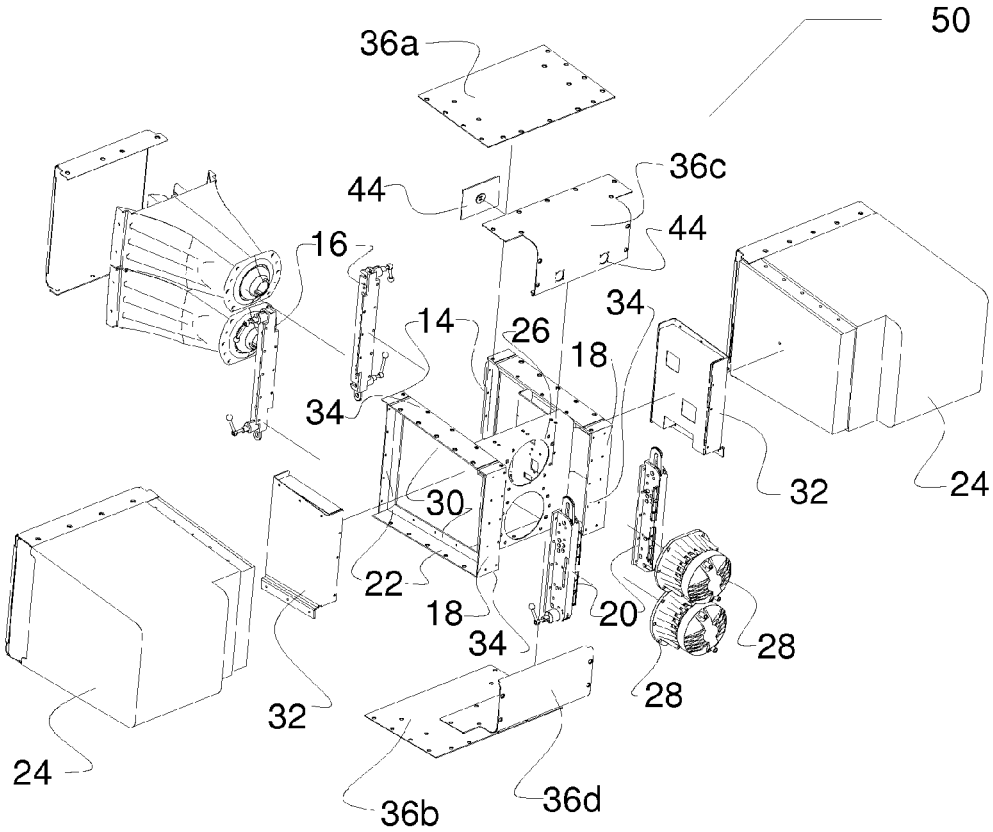

Fig. 10

| | |
|---|---|
| 14 | Front rigging attachment interfaces |
| 16 | Front rigging components |
| 18 | Back rigging attachment interfaces |
| 20 | Back rigging components |
| 22 | Enclosure attachment interfaces |
| 24 | Enclosures |
| 26 | Transducer attachment interface |
| 28 | Transducer assemblies |
| 30 | Amplifier attachment interfaces |
| 32 | Amplifier chassis |
| 33 | Amplifier cover |
| 34 | Cover plate attachment interface |
| 36a | Top cover |
| 36b | Bottom cover |
| 36c,d | Back covers |
| 44 | Electronic interface |
| 50 | Array element |

| | |
|---|---|
| 16 | Front rigging components |
| 20 | Back rigging components |
| 24 | Enclosures |
| 36a | Top cover |
| 50 | Array element |

| | |
|---|---|
| 20 | Back rigging components |
| 24 | Enclosures |
| 36b | Bottom cover |
| 36d | Back cover |
| 44 | Electronic interface |
| 50 | Array element |

| | |
|---|---|
| 24 | Enclosures |
| 52 | Band-pass low frequency array element |
| 54 | Rectangular structural module |
| 56 | Enclosure attachment interface |
| 58 | Enclosure |
| 60 | Attachment interface |
| 62 | Cover panels |
| 64 | Transducers |

| | |
|---|---|
| 70 | Rigging components |
| 72 | Electronic equipment attachment interface |
| 74 | Electrical equipment |
| 76 | Baffle plate |
| 78 | Electromagnetic motor |
| 79 | Heat sink |
| 80 | Transducer frame |

| | |
|---|---|
| 82 | Enclosure |
| 84 | Structural module |

| | |
|---|---|
| 10 | Structural module |
| 16 | Front rigging components |
| 24 | Enclosures |
| 36a | Top cover |
| 50 | Array element |

| | |
|---|---|
| 20 | Structural module |
| 24 | Enclosures |
| 36a | Top cover |
| 36b | Bottom cover |
| 50 | Array element |

LOUDSPEAKER ARRAY ELEMENT

CROSS-REFERENCE TO RELATED APPLICATION

This application is a National Phase application claiming the benefit of No. PCT/CA2011/050645 filed on Oct. 13, 2011 in English, which further claims priority to U.S. Provisional Application No. 61/392,897, titled "ARRAY ELEMENT" and filed on Oct. 13, 2010, the entire contents of which are incorporated herein by reference.

BACKGROUND

The present disclosure relates generally to loudspeaker systems. More particularly, the present disclosure relates to arrays of commercial loudspeaker array elements.

Large arrays of full frequency range loudspeakers have been the standard for producing high sound pressure levels for concert production and performance installation for several decades. In the early days of professional audio, loudspeaker array designers attempted to direct audio three dimensionally in clusters of loudspeakers known as spherical arrays. Since the turn of the millennium many array designs have involved a vertical row of loudspeaker enclosures arranged symmetrically on either side of a centrally oriented vertical slot, energized by high frequency transducers. This has become known as the line array.

Array elements are generally connected one to another by a rigging system attached directly to the enclosure to form the array. Rigging systems generally include adjustable metal parts allowing the desired angular relationship between the elements of the array to be achieved. In order to achieve a curved array, rigging systems are typically provided with two sets of components, one set mounted near the front of and the other mounted near the back of the enclosure. By this method a stable curved array may be formed.

The desired array geometry is most often determined by dedicated simulation software that predicts the likely acoustic behaviour of the array in the listening environment. Based on the simulation software the geometry is optimized prior to array assembly so that when erected the individual array elements point at the exact prescribed locations in the listening area creating even sound pressure distribution. Because of the limited length of the array and the geometry of typical listening environments, the shape of the array is typically curved and most often the curvature increases toward the lower portion of the array. A precise and predictable angular setting between the elements is therefore essential.

The overwhelming material of choice for the primary structure of the loudspeaker enclosure has been wood in one form or another, although in recent years many new materials have been introduced. The benefits of wooden construction for low and mid frequency reproduction are known. Wood construction is acoustically beneficial when sound pressure from the rear of a speaker cone interacts with the wooden enclosure directly.

In sealed back chamber transducers, which may be used for mid and high frequency reproduction, the sound pressure is contained within the transducer and a molded horn or chamber that is isolated from the enclosure surrounding it. In this form there is no benefit to enclose these transducers in a wooden enclosure.

While wood exhibits acoustic properties that are beneficial, there are many limitations associated with its manufacturing characteristics and structural properties. The manufacturing process of wooden enclosures often results in dimensional deviations from the product specification. Where rigging systems are attached directly to a wooden array element mechanical stresses from assembling and erecting (flying) an array or from transportation may cause added distortions. These dimensional variations may result in inaccurate angles between array elements causing a distortion of the desired curvature of the array.

Furthermore, additional temporary dimensional distortions may arise from mechanical flexural stresses induced in the array elements when the weight of the entire array is borne by the rigging systems. As elements are added to the array, the flexing of the uppermost wooden components increases dramatically, resulting in load dependent angular changes within the array.

Given the structural disadvantages of wooden enclosures, composite materials are sometimes used for enclosures. Array elements built with these enclosures can be more accurately constructed allowing for faster assembly during manufacturing. Additionally, they are less likely to deviate due to mechanical stress resulting in an element that is less likely to suffer from rigging misalignment during array assembly. However, using a composite enclosure does not take advantage of the acoustical benefits of wooden enclosures.

In the typical manufacturing environment, manual labor is employed in the assembly and finishing of the wooden loudspeaker enclosure. The wooden enclosure component of a large array element can be unwieldy and difficult to handle in the production environment as it might weigh more than 100 lbs. Whether the enclosure is wood or composite material current array elements may be quite large and heavy when fully assembled. Dimensions of up to 58" wide×27" depth× 18.5" height and weight of up to 270 lbs are not uncommon.

Another characteristic of the wooden loudspeaker enclosure is that wood is a thermal insulator. Generally, low frequency enclosures are acoustically vented to enhance efficiency. A byproduct of this venting is that heat dissipation from the low frequency transducer is aided by air movement through the enclosure vent. When heat generating electronic equipment or an unvented transducer such as a high or mid frequency horn transducer is added to a wooden loudspeaker enclosure, metal heat sinking or some other method of heat removal becomes an important consideration since the wood will limit the dissipation of excess heat from the system.

Arrays of low frequency array elements have also become popular in recent years. The problems associated with low frequency array elements are similar to those encountered with full range array elements. One important difference is that most low frequency array elements are rectangular in cross section and therefore low frequency arrays are generally not curved (although curvature may be required in some instances). In many cases, low frequency elements are significantly larger than the full range elements with which they operate.

In the manufacturing environment, in all phases beyond primary assembly, the size and weight of low frequency array elements poses challenges to workers. Specifically, the wood enclosure assembly, paint preparation, painting and installation of all components each poses a particular difficulty when the size and weight of the array element exceeds the size and weight that can be managed by a single worker.

SUMMARY

A loudspeaker array element is provided, where the array element includes an internal rigid structural frame and at least one interface for attaching one or more of enclosures, rigging components, waveguides, sound chambers, transducers and electronics to the frame. Further configurations are provided for heat sinking of electrically powered devices such as loudspeakers, as well as power amplifiers, digital signal processing and networking hardware.

Accordingly, in one aspect, there is provided a structural module for constructing a loudspeaker array element, the module comprising: a rigid structural frame; and at least one attachment interface integrated with the rigid structural frame for connecting one or more array element components to the rigid structural frame.

In another aspect, there is provided a loudspeaker array element comprising: a structural module as described above, wherein the at least one attachment interface includes at least one rigging attachment interface and at least one enclosure attachment interface; at least one loudspeaker enclosure attached to a respective enclosure attachment interface; at least one rigging component attached to a respective rigging attachment interface; at least one transducer attachment interface integrated with one of the rigid structural frame and the loudspeaker enclosure; and at least one transducer attached to a respective transducer attachment interface; wherein the rigging component is configured for connecting the loudspeaker array element to an another loudspeaker array element.

In another aspect, there is provided a loudspeaker array comprising two or more loudspeaker array modules provided as described above; wherein adjacent loudspeaker array elements forming the loudspeaker array are connected by the rigging components.

In another aspect, there is provided a structural module for constructing a loudspeaker array element, the module comprising: a rigid structural frame; at least one enclosure attachment means for attaching a loudspeaker enclosure to the structural module, wherein the enclosure attachment means is provided on the rigid structural frame; and at least one rigging attachment means for attaching a rigging component to the structural module, wherein the rigging attachment means is provided on the rigid structural frame.

A further understanding of the functional and advantageous aspects of the disclosure can be realized by reference to the following detailed description and drawings.

BRIEF DESCRIPTION OF THE DRAWINGS

Embodiments will now be described, by way of example only, with reference to the drawings, in which:

FIG. 9 is an isometric front facing assembly view of the array element showing the relationships of all components to the module;

FIG. 10 is an isometric rear facing assembly view of the array element showing the relationships of all components to the module;

DETAILED DESCRIPTION

Figure 1:
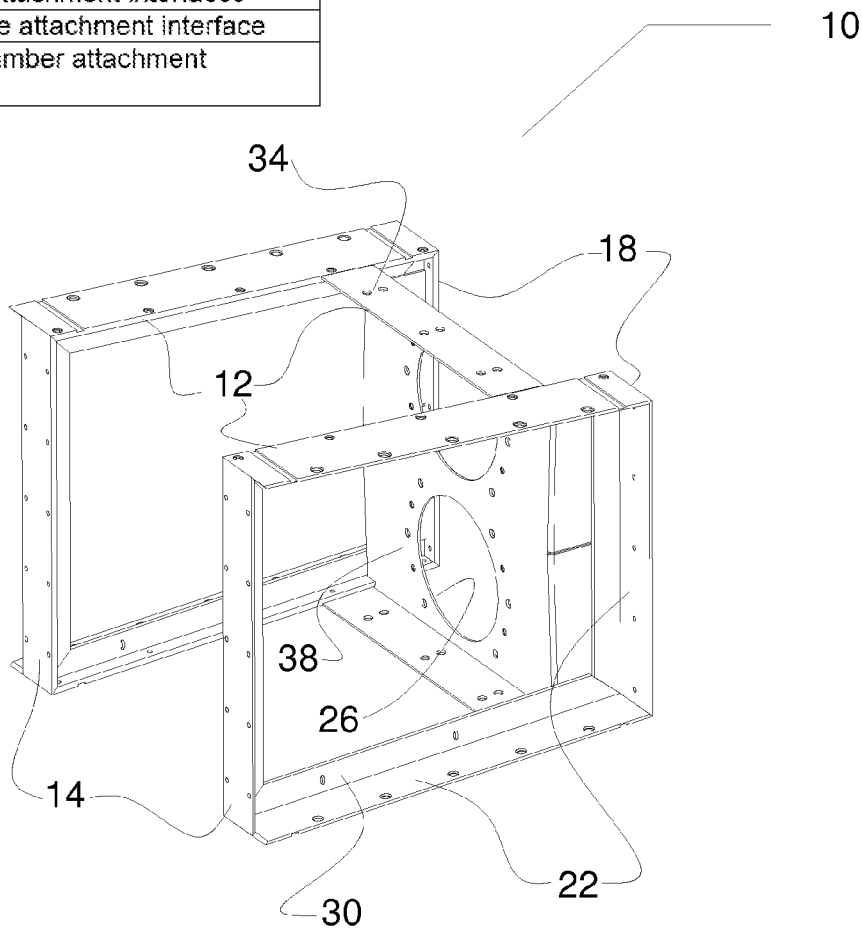
FIG. 1 is isometric view of a structural module.

Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the terms "about" and "approximately", when used in conjunction with ranges of dimensions of particles, compositions of mixtures or other physical properties or characteristics, are meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present disclosure.

As used herein, the term "loudspeaker array" means an assembly of loudspeaker array elements, where the assembly contains at least two array elements.

As used herein, the terms "array element" and "loudspeaker array element" refer to a loudspeaker assembly including one or more audio transducers. An array element contains a plurality of components which may include one or more enclosures which define volumes of air for associated transducers, and/or one or more sound chambers. Array element components may further include rigging hardware, amplifiers, heat sinks, digital signal processing hardware or networking hardware or some combination of these components.

As used herein, the term "array element component" means any mechanical, electrical or transducer component that is attachable for any purpose to the rigid structural module.

As used herein, the term "sound chamber" means a device used in conjunction with an acoustic transducer in communicating sound from the array element. Examples of sound chambers include horns, waveguides, and acoustic lenses.

Embodiments provided herein provide a structural module (10) for constructing a loudspeaker array element, and corresponding array elements and arrays formed from said array elements. A structural module for forming a loudspeaker array element provides a rigid structural frame and includes plurality of integral attachment interfaces for attaching various components to the rigid structural frame for assembling an array element and for connecting the array element to one or more other array elements to form an array.

Referring now to FIG. 1, an example embodiment is illustrated in which structural module (10) is shown including rigid frame (12), two front rigging attachment interfaces (14), and two back rigging attachment interfaces (18). Front and back rigging attachment interfaces (14, 18) are respectively positioned generally towards outer edges of the structural frame (12) and are configured to be attached using machine screws or other suitable fasteners to respective fixed or adjustable rigging components (16, 20), such as those shown in FIG. 2 or as described in detail in U.S. patent application Ser. No. 12/903,925 entitled "ARRAY ELEMENT RIGGING COMPONENT, SYSTEM AND METHOD", filed by Adamson et al. on Oct. 13, 2010, the Detailed Description and Figures of which are incorporated herein by reference. Rigging components (16, 20) are configured for interconnecting structural module (10) with one or more other adjacent structural modules to form an array of array elements.

Rigid frame (12) and one or more attachment interfaces defining structural module (10) may be made from a lightweight, high strength material such as aluminum, steel or a suitable composite and takes advantage of the structural properties of the material. Examples of composites include Kevlar™, polyester based sheet mold compound, such as those used in the automotive industry, and fiber-epoxy composites. As can be seen, the structural module (10) provides a rigid core in and around which several components of an array element and rigging components may be attached. The structural module (10) provides dimensional and structural stability that is not provided by known loudspeaker assembly designs. The high strength and stiffness of the structural module (10) increases the dimensional stability of the array element during manufacturing and assembly, which improves manufacturing efficiency. In the examples presented here, the tensile strength of the rigid frame is substantially greater than that of wood, which is about 6-10 MPa. For example, the rigid frame may be made from aluminum, which is known to have a tensile strength of about 290 MPa, and a yield strength of approximately 240 MPa. In some embodiments, the tensile strength of the frame is greater than or equal to approximately 260 MPa and the yield strength is greater than about 220 MPa.

In one embodiment, the structural module is made from a material that is selected to provide dimensional stability when the array element is attached to adjacent elements such that the array element supports the weight of one or more additional array elements. For example, the structural module may be made from a material that exhibits substantially greater dimensional stability than an equivalent wooden structure.

In one embodiment, one or more components of structural module (10), such as rigid frame (12) and one or more attachment interfaces, may be formed from a thermally conductive material. Suitable thermally conductive materials include aluminum, steel, and alloys such as magnesium alloys. Accordingly, the structural module, when thermally conductive, may function as a heat sink for conducting heat generated within the array element.

The various interfaces allow the attachment of array element components and rigging components. Such components may be attached to their respective interfaces using attachment devices known to a wide variety of industrial fields, including, but not limited to, typical fasteners such as screws and bolts, as well as other attachment devices such as clips, pins, clamps and crimped fittings.

Figure 2:
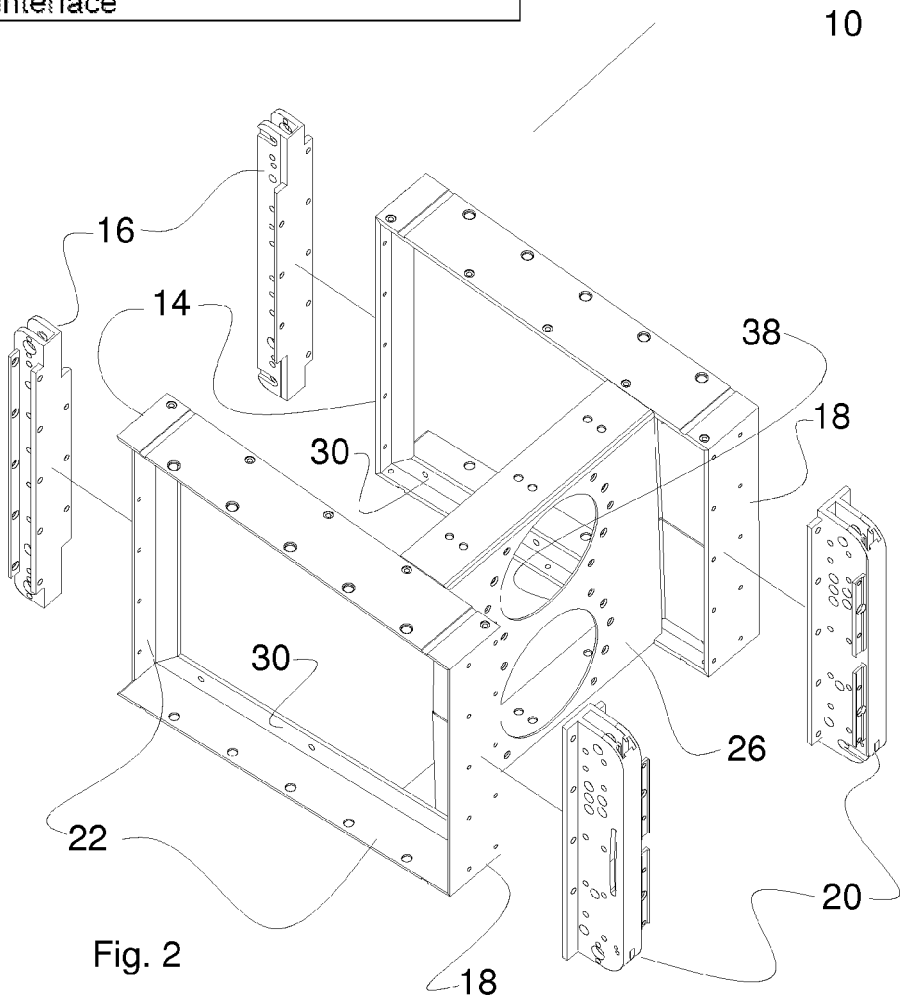
FIG. 2 is an isometric assembly view of the structural module showing rigging components and their relationship to the module.

The illustrations of FIGS. 1 and 2 show an example structural module (10) including two or more attachment interfaces (14, 18, 22, 26, 30, 34, 38) of each type. It is to be understood that an array element (50) may be configured with less than two of any of these attachment interfaces (14, 18, 22, 26, 30, 34, and 38). The attachment of such components to their respective interfaces is further described below.

FIG. 2 illustrates an assembly view of structural module (10) showing front rigging components (16) associated with the front rigging attachment interfaces (14) and back rigging components (20) associated with the back rigging attachment interfaces (18) positioned adjacent their respective attachment interfaces (14, 18). Advantageously, rigging components (16, 20) may be constructed of a thermally conductive material and be thermally connected to the structural module (10). As a result, connection of the rigging components (16, 20) to the structural module (10) effectively expands the overall heat sinking capacity of the structural module (10), as discussed in further detail below.

Although the examples illustrated in the Figures generally show attachment interfaces as suitable surfaces (such as planar surfaces) that are configured for attachment of array element components using fastening devices, it is to be understood that attachment interfaces may take on a wide variety of different geometries for attaching various array element components. Furthermore, attachment interfaces may be attached to the rigid frame according to a wide variety of attachment means or methods. Similarly, array element components may be attached to the array attachment interfaces according to a wide variety of attachment means or methods. Suitable attachment methods include, but are not limited to, welding, bonding with an adhesive, clamping, friction fit, crimping, physical interlocking, and any combination thereof. One or more attachment interfaces may be attached to the rigid frame or directly integrated with the rigid frame.

In other embodiments, one or more array element components may be directly integrated with rigid frame. For example, one or more rigging components may be directly integrated with the rigid frame, such as by welding one or more rigging components to the rigid frame.

Figure 3:
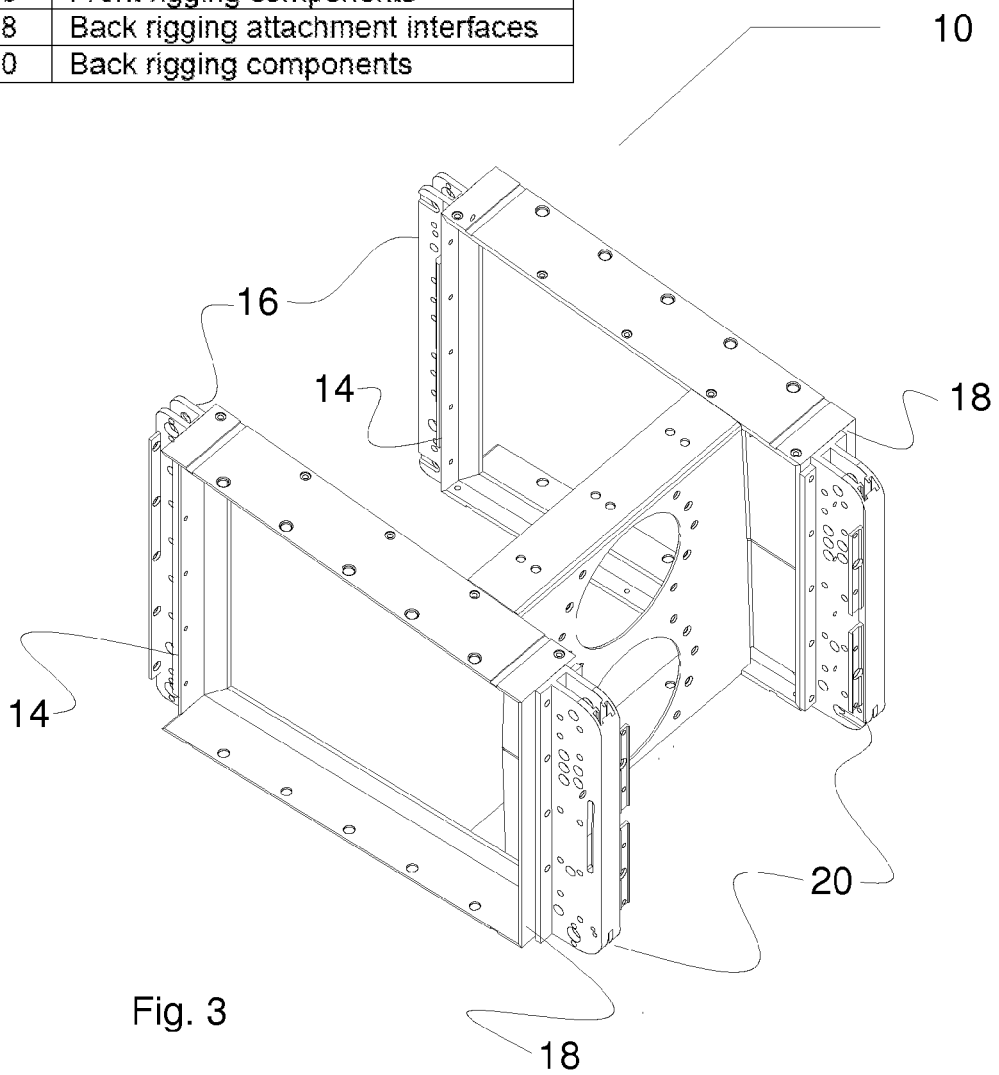
FIG. 3 is an isometric view of the structural module showing rigging components attached to the module.

FIG. 3 illustrates the structural module (10) with the rigging components (16, 20) fixed to their respective attachment interfaces (14, 18). As noted above, the contact of a rigging component with its respective rigging attachment interface provides a path externally heat sinking heat that is generated within the array element (10).

Figure 4:
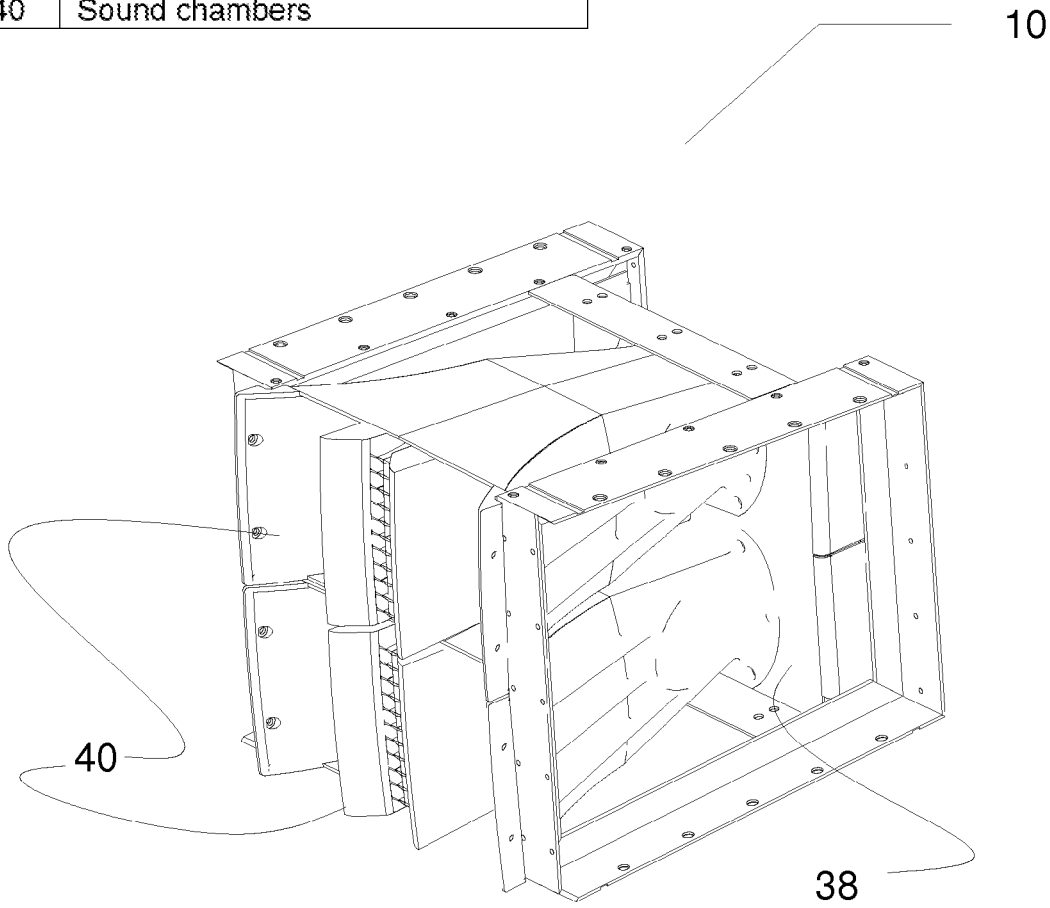
FIG. 4 is an isometric front facing view of the structural module showing sound chamber components installed in the module.
Figure 5:
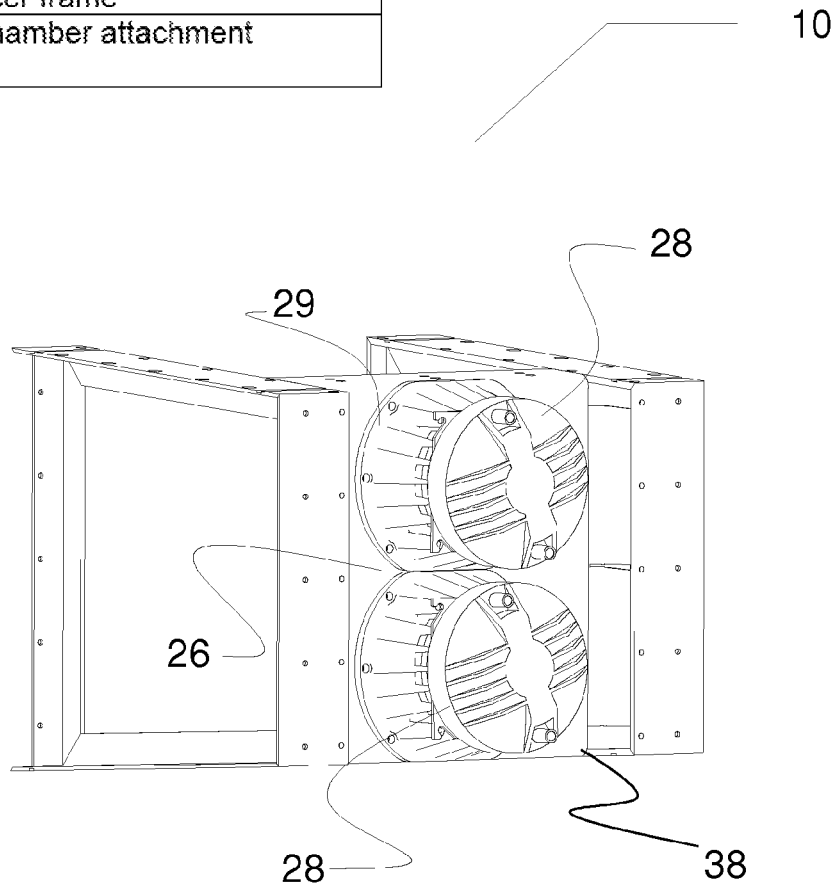
FIG. 5 is an isometric rear facing view of the structural module showing transducer components installed in the module.

FIG. 4 illustrates the structural module (10) with sound chambers (40) fixed to the sound chamber attachment interface (38). As shown in FIGS. 4 and 5, transducer attachment interface (26) and sound chamber attachment interface (38) may be provided as an integrated component that is configured for securing both transducers and sound chambers. Structural module (1) may also include at least one sound chamber attachment interface (38) for securing a sound chamber relative to a transducer. The sound chamber components (40) are shown adjacent the sound chamber attachment interfaces (38).

Structural module (10) also includes at least one integral transducer (or driver) attachment interface, which are illustrated in FIG. 1 as transducer attachment interface (26) provided a back plate that extends between and is attached to back portions of two enclosure attachment interfaces (22).

FIG. 5 illustrates structural module (10) with transducer assemblies (28) fixed to the transducer attachment interface (26). Example transducer assembly (28) may be an electro-acoustical transducer or driver such as a horn transducer, or an assembly of electro-acoustical transducers such as a co-entrant mid and high frequency transducer combination as shown in FIG. 5 that produces sound as a result of electrical input. The electrical input causes heating to the transducer as an unwanted by-product of its operation. As a result, the transducer frame (29) will generally be warmed by its operation.

In one embodiment, transducer attachment interface (26) may be formed from a thermally conductive material so that when transducer frame (29) is attached structural module (10) at transducer attachment interface (26), it thermally conducts heat away from transducer frame (29) into the structural module (10). Such a thermally conducting attachment is generally achieved through a tight and continuous contact between two objects, and may be aided by the application of a thermally conducting compound to the mating objects.

Figure 6:
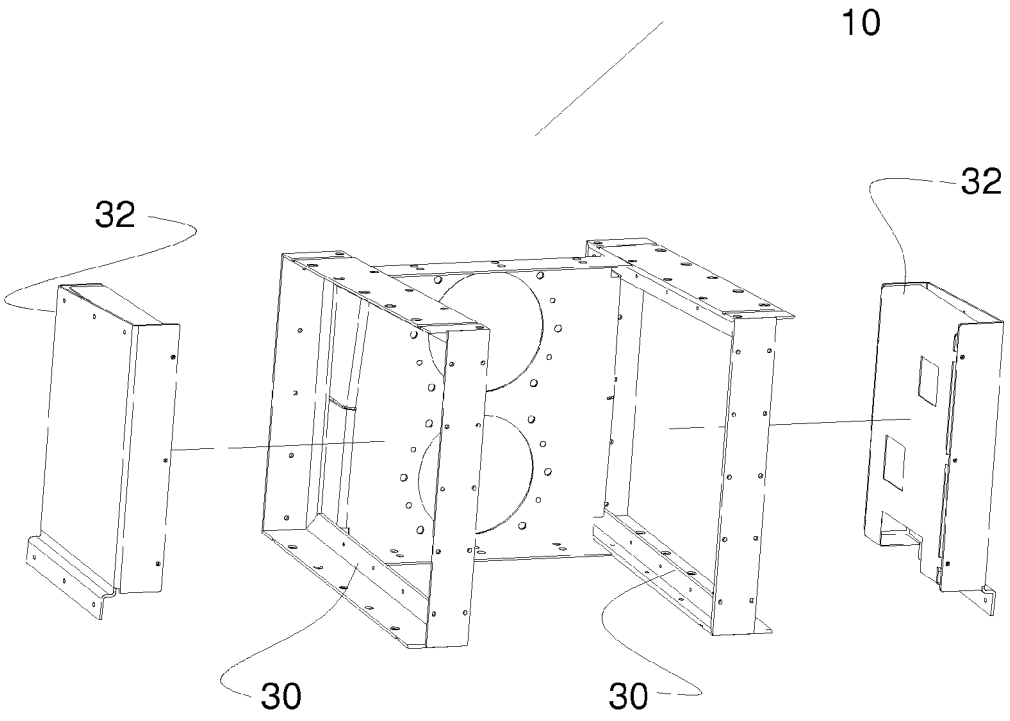
FIG. 6 is an isometric assembly view of the structural module showing amplifier components and their relationship to the module.
Figure 7:
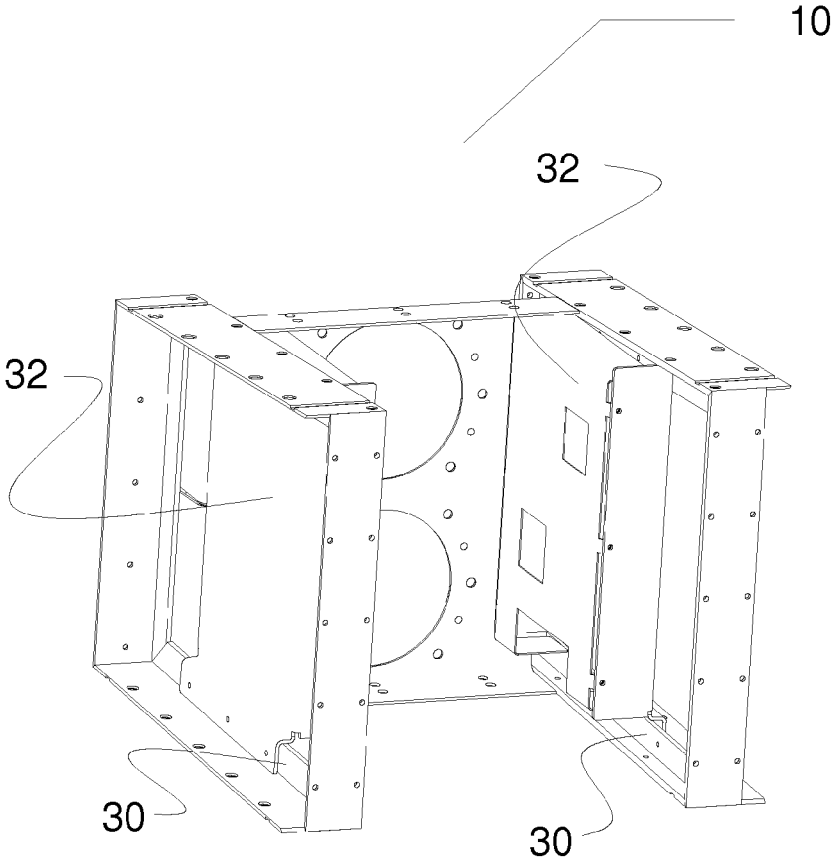
FIG. 7 is an isometric view of the structural module showing amplifier components installed in the module.

Structural module may also include at least one integral amplifier attachment interface for securing and supporting an amplifier. FIG. 6 illustrates an example embodiment where two integral amplifier attachment interfaces (30) are shown located adjacent to respective enclosure attachment interfaces (22). In FIG. 6, an isometric assembly view of the structural module (10) is provided with an amplifier chassis (32) positioned adjacent the amplifier chassis attachment interfaces (30). FIG. 7 illustrates the structural module (10) with amplifier chassis (32) fixed to the amplifier chassis attachment interface (30). Amplifiers may have as many channels as required to power the individual transducers in the array element. Amplifier chassis (32) are electrically connected to one or more transducers or drivers housed within the loudspeaker array element.

An amplifier is an electrically energized device that amplifies a signal as a result of electrical input. The electrical input causes heating in the amplifier as an unwanted by product of its operation. The chassis (32) of the amplifier may be configured as a heat sink and be warmed by its operation. Accordingly, in one embodiment, amplifier attachment interface (30) is thermally conductive such that it removes hear from amplifier chassis (32), and thermally conducts the heat to rigid frame (12).

Structural module (10) also includes two integral enclosure attachment interfaces (22) for receiving and attaching to up to two enclosures, such as loudspeaker enclosures (as described further below). Enclosures may be secured to one or more surfaces of integral enclosure attachment interfaces using fasteners such wood screws, machine screws or other suitable fasteners. In the example embodiment shown, the enclosure attachment interfaces (22) are shown as being laterally arranged and trapezoidal in shape for receiving and attaching to enclosures that are trapezoidal in cross-section.

Figure 8:
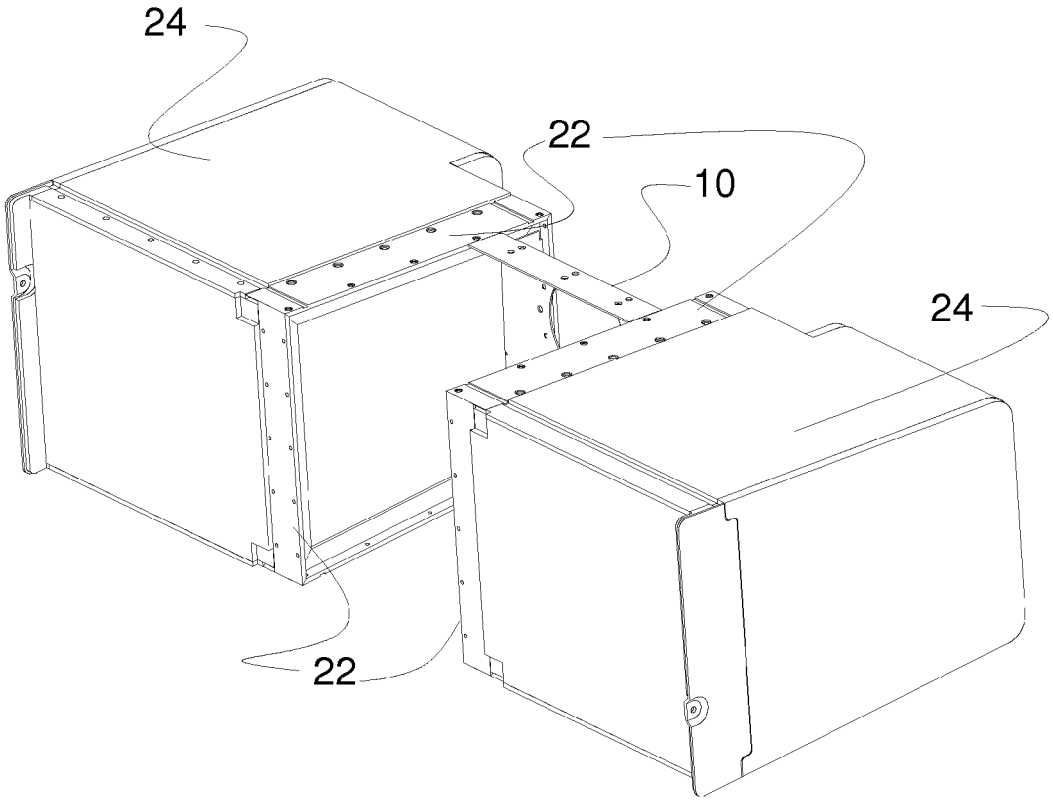
FIG. 8 is an isometric view of the structural module showing enclosures installed on the module.

FIG. 8 illustrates the structural module (10) with enclosures (24) fixed to the enclosure attachment interface (22). In the embodiment shown, an enclosure attachment interface (22) is dimensioned to receive a corresponding enclosure 24. Enclosure 24 may include a low frequency transducer such as a woofer, and may further include a baffle. Enclosure 24 may be a vented enclosure. In one embodiment, enclosure 24 provides a box suitable for housing a woofer.

FIG. 9 illustrates a front view of an assembly of a complete array element (50). Front rigging components (16) are shown adjacent the front rigging attachment interfaces (14). Back rigging components (20) are shown adjacent the back rigging attachment interfaces (18). Loudspeaker enclosure components (24) are shown as laterally adjacent to the enclosure attachment interfaces (22). Transducer components (28) are shown adjacent to the transducer attachment interfaces (26). The amplifier chassis components (32) and an amplifier cover (33) are shown adjacent to the amplifier chassis attachment interfaces (30). The respective orientations of all components previously described (16, 20, 24, 28, 32 & 40) are shown in relation to the structural module (10).

Structural module (10) may also include at least one cover plate attachment interface (34) for attaching cover plates (as further described below) to enclose an internal volume of rigid frame (12). An the example embodiment illustrated in FIGS. 9 and 10, a group of four cover plates (36) encloses the top, bottom and back of the structural module (10). The top cover (36*a*) and the bottom cover (36*b*) connect to cover plate attachment interfaces (34*a*) and (34*b*), respectively shown in FIG. 10. The two back covers (36*c* & 36*d*) connect to the cover plate attachment interfaces (34*c*) and (34*d*) respectively shown in FIG. 10 and also connect to the top cover plate (36*a*) and the bottom cover plate (34*b*) respectively.

As noted above, any one or more of the cover plates (36), the structural module (10), the amplifier chassis (32), the transducer frame (29) and the rigging components (16 & 20) may be made from a thermally conducting material thus forming a large heat sink for the dissipation of heat caused by the operation of the heat producing devices within the array element (50).

FIG. 10 illustrates the rear view of an assembly of a complete array element (50). Front rigging components (16) are shown adjacent the front rigging attachment interfaces (14). Back rigging components (20) are shown adjacent to the back rigging attachment interfaces (18). The loudspeaker enclosure components (24) are shown adjacent to the enclosure attachment interfaces (22). The transducer components (28) are shown adjacent to the transducer attachment interfaces (26). The amplifier chassis components (32) are shown adjacent to the amplifier chassis attachment interfaces (30). The respective orientations of all components previously described (16, 20, 24, 28, 32 40) are shown in relation to the structural module (10).

Back cover plates (36*c* & 36*d*) may contain an electrical connection interface (42) which may be a typical loudspeaker cable for delivering a preconditioned amplified signal directly to the loudspeakers. Electrical connection interface (42) may include connector and/or plugs. Alternatively electrical connection interface may be an electronic interface (44) containing networking or signal processing hardware and software, and cables and/or connectors for the delivery of electrical power. Networking hardware may be Ethernet-type network equipment. Signal processing hardware and software may include digital signal processing (DSP) hardware and software, for example, for providing equalizers and band pass filters. Electronic interface (44) may support one or more of audio, digital, and communication channels, and may also provide electrical power. Electronic interface (44) is also shown in FIG. 9. In cases where the electronic interface (44) produces heat, the interface (44) may be thermally connected to the cover plate (36*c*) for the purposes of heat dissipation.

Figure 11A:
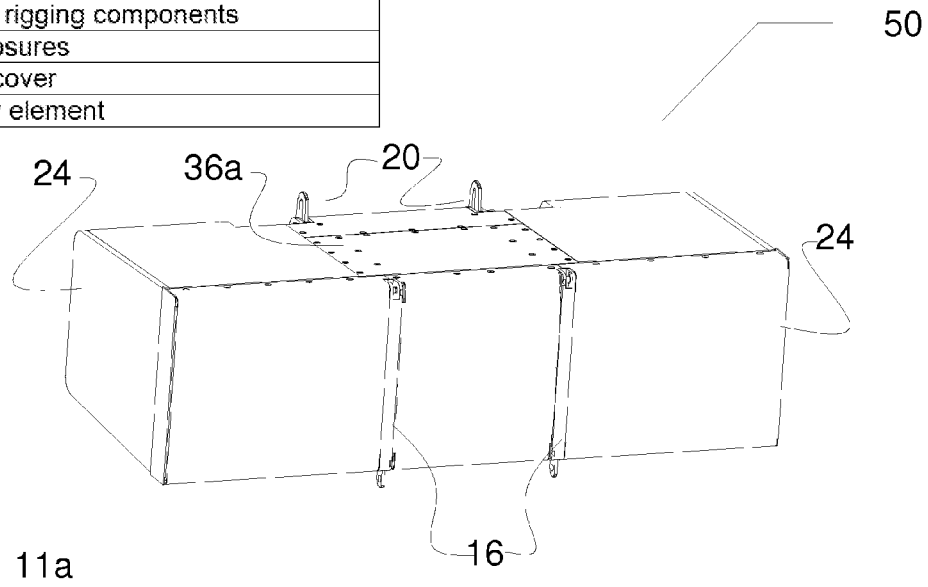
FIG. 11*a* is an isometric front facing view of the complete array element showing all components installed on the module.
Figure 11B:
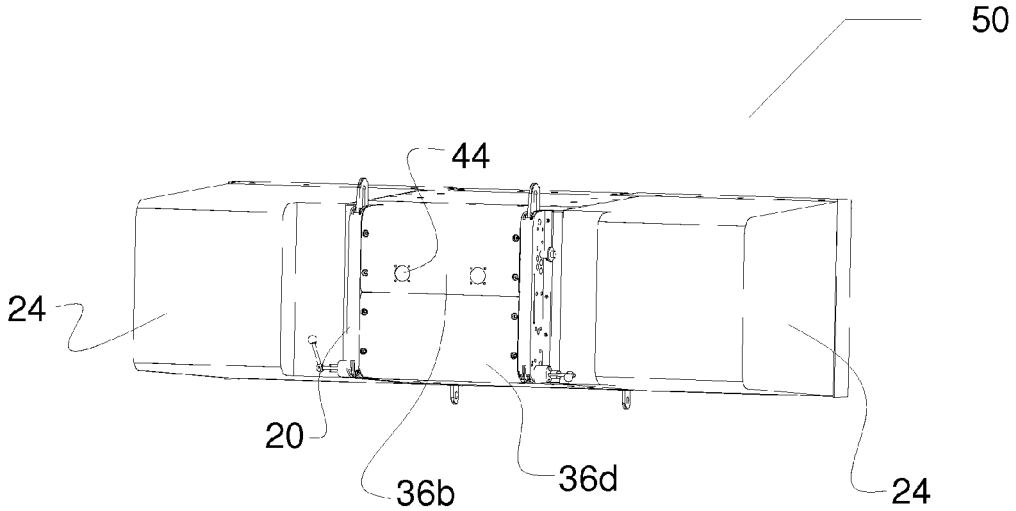
FIG. 11*b* is an isometric rear facing view of the complete array element showing all components installed on the module.

FIG. 11*a* illustrates the front isometric view of a complete array element (50) showing the front rigging components (16), the rear rigging components (20), the top cover plate (36*a*) and the enclosures (24). FIG. 11*b* illustrates the rear isometric view of a complete array element (50) showing the back rigging components (20), back cover plates (36*c* & 36*d*), the electrical interface and the enclosures (24).

Figure 12A:
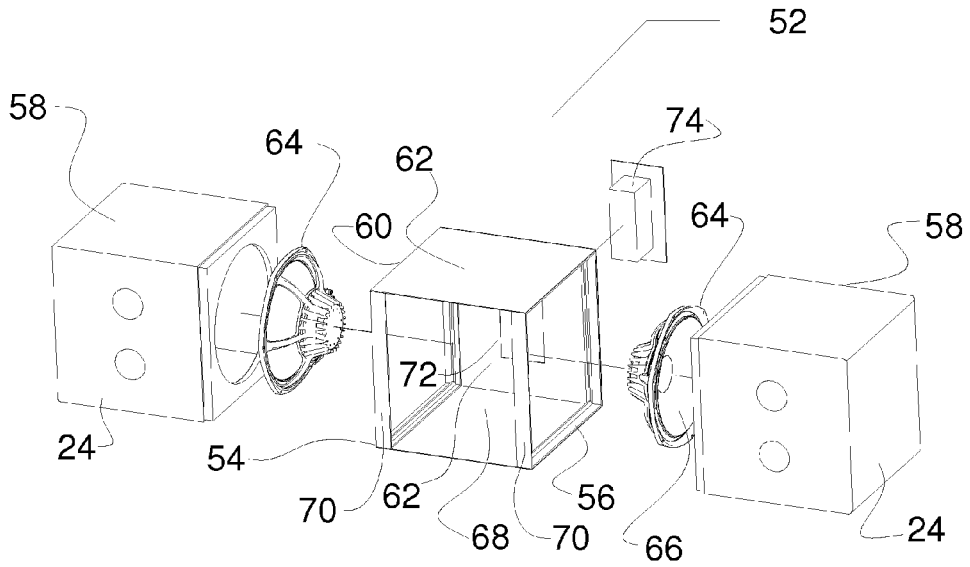
FIG. 12 is an isometric front assembly view of a low frequency array element.

FIG. 12*a* illustrates an embodiment of a band-pass low frequency array element (52) including a rectangular structural module (54) with at least an enclosure attachment interface (56) and at least one enclosure (58), at least one transducer (64) and at least an attachment interface (60) for cover panels (62). It will be appreciated that structural module (54) and cover panels (62) can be configured as separable components or as one integral structure.

In the embodiment shown in FIG. 12, low frequency transducers (64) are mounted to and face toward the interior of the enclosures (58), exposing the back side of the transducers (64). In typical band-pass configurations such as this high sound pressure levels are generated on both sides of the loudspeaker diaphragm (66). In this embodiment the volume of air within the structural module (68) is exposed to intense sound pressure. In order to control vibration, cover panels (62) enclosing the module (54) may be heavier than previously shown and preferably made of wood, composite material or aluminum plate.

Figure 12B:
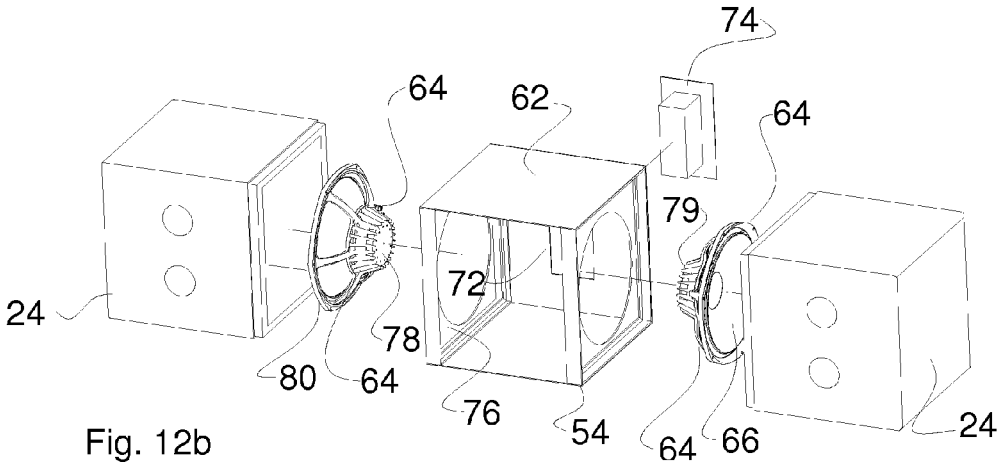

FIGS. 12*a* and 12*b* depict an embodiment with aluminum plate covers (62) integral to the rigid frame of the structural module (54). It is to be understood that structural module (54) and aluminum cover plates (62) of this embodiment may be combined into a rigid box like structure formed from of any combination of structural materials.

Embodiments may also include attachment interfaces for rigging components (70) and rigging components (not shown). The attachment interfaces (70, 72) of the embodiment described in FIG. 12*a* may be provided in a suitable location for the attachment of the associated components.

An electronic equipment attachment interface (72) may also be provided for electronic or electrical equipment (74) such as digital signal processing, networking and amplification hardware. An improved method of heat dissipation is shown in embodiments including such electronic equipment (74) in the mounting of the electronic heat producing equipment (74) to a cover plate of the structural module, where the cover plate itself may be thermally conductive as described above.

FIG. 12*b* illustrates an embodiment that provides extremely high power handling capacity. The transducers (64) used in high powered applications may include a diaphragm (66), an electromagnetic motor (78) (generally made of iron parts) and a frame (80) made of aluminum. Heat generated in the motor (78) is thermally dissipated through aluminum transducer frame (80). Frame (80) may be configured as a heat sink (79) where it contacts the motor (78).

An improved method of heat dissipation is shown in this embodiment by mounting and thermally connecting the transducer frame (80) to an aluminum baffle plate (76) which is an example of a transducer attachment interface and is shown as integral to the structural module (54). The thermal connection between transducer frame (80) and baffle plate (76) causes transducer frame (80), cover panels (62), the frame of the structural module (54) and baffle plates (76) to form a heat sink of significantly improved capacity. In particular, the surfaces of cover plates (62) are external to the whole assembly of array element (52) thus allowing the dissipation of heat to the atmosphere. It is to be understood that different configurations of heat sinking are possible within the structure that has been described.

Figure 13A:
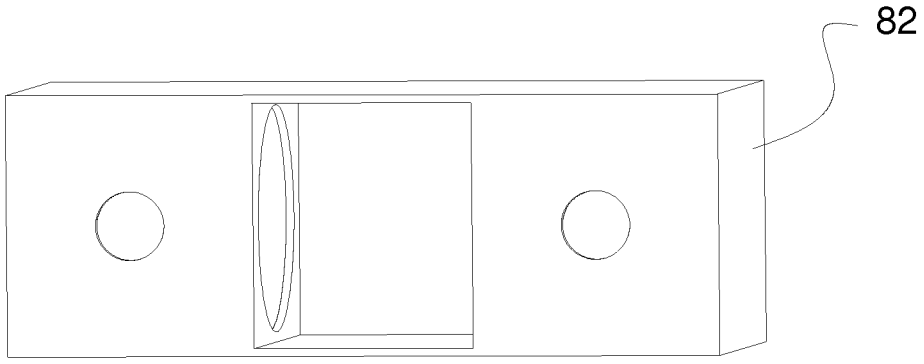
FIG. 13*a* is an isometric front view of an alternate enclosure.

FIG. 13*a* illustrates another embodiment of an enclosure (82) suited to low frequency reproduction. The array element includes transducer attachment interfaces positioned adjacent to lateral sides of the rigid frame. Each transducer attachment interface has attached thereto a low-frequency transducer, where each low-frequency transducer is oriented in a lateral outward direction relative to the rigid frame. As can be seen in the Figure, the enclosure and the low-frequency transducers define low-frequency loudspeaker elements arranged on either side of a recess adapted to receive the rigid frame.

An enclosure (82) so configured would generally contain only low frequency transducers, but could contain mid-range and high frequency components. The enclosure (82) shown may be assembled as a single component made of plywood or other material. Such an enclosure (82) may be square or rectangular in cross section.

Figure 13B:
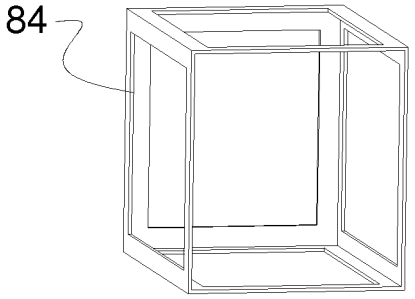
FIG. 13*b* is an isometric front view of an alternate structural module.
Figure 13C:
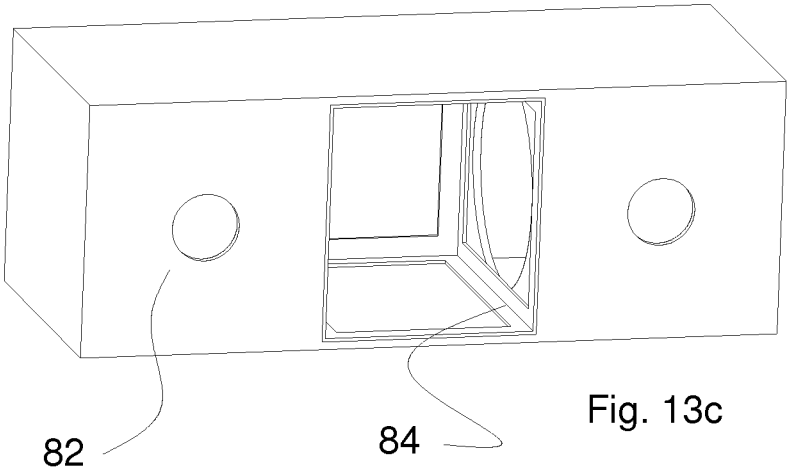
FIG. 13*c* is an isometric front view of an alternate structural module and enclosure assembled.

FIG. 13*b* illustrates another embodiment of the structural module (84) that would be suited to install in the enclosure (82) shown in FIG. 13*a*. Attachment interfaces similar to those previously described may be implemented to connect to the structural module to any suitable array element components. FIG. 13*c* illustrates the assembly of the enclosure (82) and the structural module (84).

Figure 14:
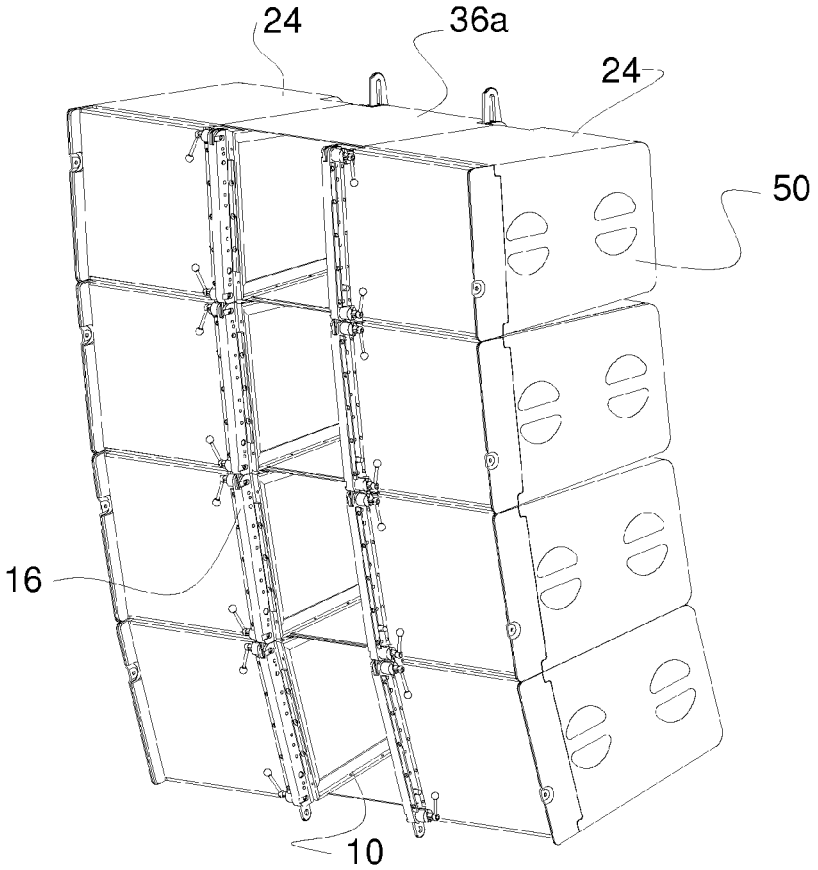
FIG. 14 is an isometric front view of an assembled array of four elements.
Figure 15:
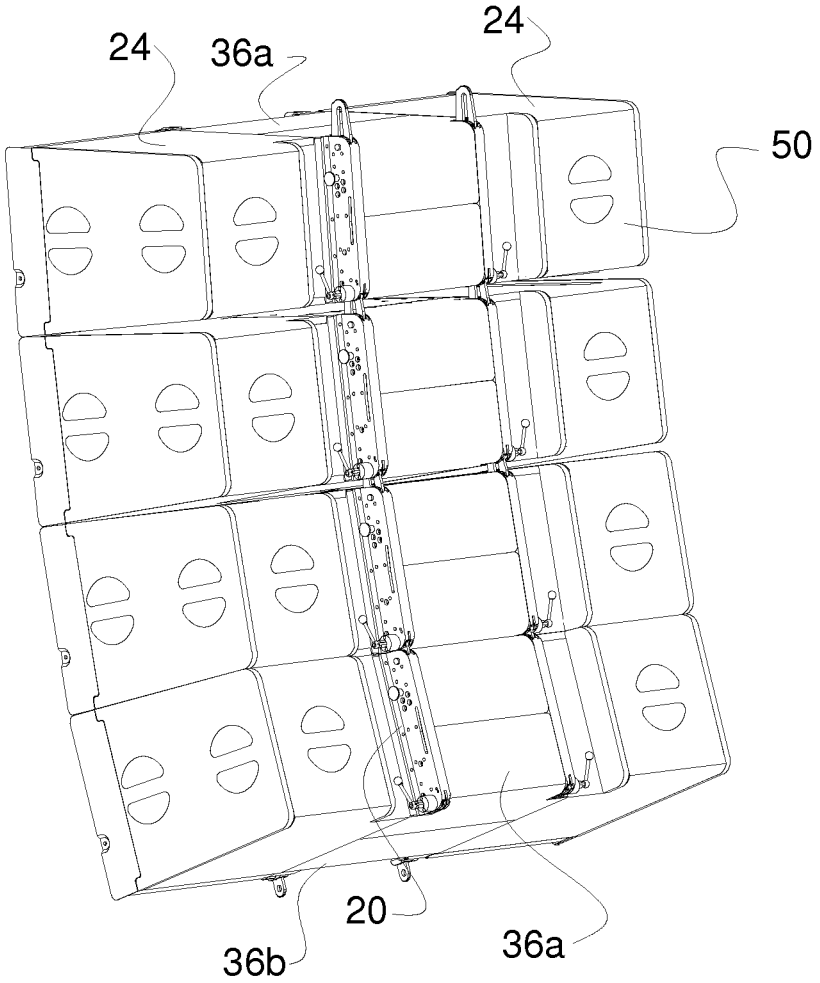
FIG. 15 is an isometric rear view of an assembled array of four elements.

FIG. 14 illustrates the front isometric view of an assembled array of elements (50) showing the structural module (10), the front rigging components (16), the enclosures (24) and a top cover plate (36*a*). FIG. 15 illustrates the rear isometric view of an assembled array of elements (50) showing the enclosures (24) the back rigging components (20) a top cover plate (36*a*) a bottom cover plate (36*b*) and the back cover plates (36*d*). The electronic interface is not shown in this view.

It is to be understood that an array element according to the preceding embodiments may take on a wide variety of forms and complexity, depending on the application. In one embodiment, an array element may include a single enclosure containing a single woofer. In other embodiments, an array element may be a more complex system, for example, containing multiple array element components such as multiple enclosures, multiple transducers, multiple sound chambers, and multiple amplifiers.

The aforementioned embodiments offer a number of benefits with respect to manufacturing, service, transportation, application and performance. For example, in present day manufacturing environments, a great emphasis is placed on ergonomic considerations on the production floor. Line array elements for mid-sized to large applications are too large for one person to move without risk of injury. The embodiments provided above allow array elements to be manufactured and assembled as smaller modular components, thus reducing the stress on workers.

For example, an array element based on 15" low frequency transducers manufactured according to a present embodiment allows a single wooden enclosure to weigh as little as 20 lbs. The same size array element built according to traditional methods, with a single wooden enclosure, would weigh in excess of 100 lbs., even before components are added.

Another benefit of the present embodiments is a simplification in wood work processing. While traditional wooden enclosures often require considerable time and individual skill and expertise, array elements as provided above involve simplified wood working steps, because in some embodiments, only the speaker enclosures are made of wood.

Moreover, the array elements and methods of their construction, as disclosed above, are well suited for new array element designs that feature greater complexity. In particular, the present embodiments allow the assembly of components such as sound chambers, transducers, amplifiers, electronics and rigging components within the structural module with good manual and visual access. Furthermore, the ease of assembly and the efficient use of space accommodate the increased density of technology found within modern element designs.

The lightweight nature of array elements produced according to the above embodiments is also beneficial in that the elements are easier to manipulate during manufacture, thus making manufacturing faster, cheaper and safer.

Servicing a complex array element represents new service challenges for technicians both in the shop and in the field. Embodiments of the present disclosure may allow the development of new strategies that allow shop and field service technicians to keep spare modular components of the array element on hand and to approach the service therefore in a different manner.

During transportation and use the possibility of misalignment of the attached components is greatly reduced due to the superior structural properties of a structural frame within the array element. Furthermore, during use in the field, the superior alignment and reduced weight of the array element make it easier and faster to use.

The improved heat dissipation allows higher power handling and allows better density of technology as density demand increases.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

Therefore what is claimed is:

1. A loudspeaker array element comprising:

a rigid structural frame; and a plurality of attachment interfaces integrated with said rigid structural frame for connecting one or more array element components to said rigid structural frame said plurality of attachment interfaces comprising:

first and second loudspeaker enclosure attachment interfaces provided on first and second sides of said rigid structural frame; and a plurality of rigging attachment interfaces integrated with said structural frame for attaching rigging components thereto;

first and second loudspeaker enclosures attached to said first and second loudspeaker enclosure attachment interfaces, such that said rigid structural frame lies between the first and second loudspeaker enclosures, and such that the first and second loudspeaker enclosures extend laterally from said respective first and second sides of said rigid structural frame, said rigid structural frame thereby providing a rigid core around which the first and second loudspeaker enclosures are attached when assembling the loudspeaker array element; and a plurality of rigging components respectively attached to said plurality of rigging attachment interfaces, such that said rigging components are supported by the rigid structural frame in a region between the first and second loudspeaker enclosures, and wherein each rigging component is configured for connecting said loudspeaker array element to another loudspeaker array element;

wherein said rigid structural frame is formed from a material such that said rigid structural frame maintains dimensional stability when said loudspeaker array element is attached to one or more additional loudspeaker array elements and when said loudspeaker array element supports the weight of at least one of the one or more additional loudspeaker array elements.

2. The loudspeaker array element according to claim 1 wherein said rigid structural frame is formed from a thermally conductive material.

3. The loudspeaker array element according to claim 1 wherein one or more of said attachment interfaces are thermally conductive and in thermal contact with said rigid structural frame.

4. The loudspeaker array element according to claim 1 wherein said rigid structural frame is formed from a material selected from the group consisting of a metal and a composite.

5. The loudspeaker array element according to claim 4 wherein said metal is aluminum or steel.

6. The loudspeaker array element according to claim 1 wherein said plurality of attachment interfaces includes at least one of the following attachment interfaces:

a transducer attachment interface;

an amplifier attachment interface;

a sound chamber attachment interface;

an electronic equipment attachment interface; and a cover plate attachment interface.

7. The loudspeaker array element according to claim 1 wherein said rigid structural frame is formed from a thermally conductive material, and wherein said rigging attachment interfaces are thermally conductive, such that connection of a rigging component to a respective rigging attachment interface provides a path for external heat sinking.

8. The loudspeaker array element according to claim 6 wherein said rigid structural frame is formed from a thermally conductive material, and wherein said transducer attachment interface is thermally conductive, such that heat generated in response to electrical input provided to a transducer attached to the transducer attachment interface is conducted to said rigid structural frame.

9. The loudspeaker array element according to claim 6 wherein said transducer attachment interface includes a back plate, wherein said back plate includes one or more apertures for housing a transducer, and wherein said back plate is secured to said rigid structural frame.

10. The loudspeaker array element according to claim 1 further comprising:

at least one transducer attachment interface, wherein each transducer attachment interface is integrated with one of: (i) said rigid structural frame and (ii) said first and second loudspeaker enclosures; and at least one transducer attached to each respective transducer attachment interface.

11. The loudspeaker array element according to claim 10 wherein at least one transducer attachment interface is integrated with said rigid structural frame.

12. The loudspeaker array element according to claim 11 wherein said at least one transducer attachment interface integrated with said rigid structural frame includes a back plate, wherein said back plate includes one or more apertures for housing one or more transducers, and wherein said back plate is secured to said rigid structural frame.

13. The loudspeaker array element according to claim 10 wherein said plurality of attachment interfaces include at least one amplifier attachment interface, wherein said loudspeaker array element includes at least one amplifier attached to a respective amplifier attachment interface, and wherein said at least one amplifier is electrically connected to one or more transducers housed within said loudspeaker array element.

14. The loudspeaker array element according to claim 10 wherein said at least one transducer includes a mid-frequency transducer and a high-frequency transducer.

15. The loudspeaker array element according to claim 11 wherein said plurality of attachment interfaces integrated with said rigid structural frame includes at least one sound chamber attachment interface, wherein said loudspeaker array element includes at least one sound chamber attached to a respective sound chamber attachment interface.

16. The loudspeaker array element according to claim 11 wherein one or more of said first and second loudspeaker enclosures includes an additional transducer.

17. The loudspeaker array element according to claim 10 wherein said at least one transducer comprises first and second low-frequency transducers respectively directed into said first and second loudspeaker enclosures.

18. The loudspeaker array element according to claim 17 wherein the transducer attachment interfaces to which said first and second low-frequency transducers are attached are thermally conductive baffle plates secured to said rigid structural frame.

19. The loudspeaker array element according to claim 18 wherein each baffle plate is formed from aluminum.

20. The loudspeaker array element according to claim 10 wherein said first and second enclosure attachment interfaces are arranged on opposite sides of said rigid structural frame, each having attached thereto a respective laterally-positioned loudspeaker enclosure.

21. The loudspeaker array element according to claim 10 wherein said at least one transducer comprises first and second transducers, and wherein said plurality of attachment interfaces comprise first and second transducer attachment interfaces integrated with said first and second loudspeaker enclosures, and wherein said first and second transducers are respectively attached to said first and second loudspeaker attachment interfaces.

22. The loudspeaker array element according to claim 21 wherein said first and second transducers are laterally-oriented low-frequency transducers respectively directed into said first and second loudspeaker enclosures.

23. The loudspeaker array element according to claim 21 wherein said first and second loudspeaker enclosures each include a transducer attachment interface, and wherein said first and second loudspeaker enclosures are positioned adjacent to lateral sides of said rigid structural frame, each transducer attachment interface having attached thereto a low-frequency transducer, wherein each low-frequency transducer is oriented in a lateral outward direction relative to said rigid structural frame, such that each enclosure and each respective low-frequency transducers define low-frequency loudspeaker elements arranged on either side of said rigid structural frame.

24. The loudspeaker array element according to claim 10 wherein said plurality of attachment interfaces include at least one cover plate attachment interface, wherein said loudspeaker array element includes at least cover plate attached to a respective cover plate attachment interface.

25. The loudspeaker array element according to claim 24 wherein said cover plate is thermally conductive, thereby forming an external heat sink.

26. A loudspeaker array comprising:

two or more loudspeaker array modules provided according to claim 1;

wherein adjacent loudspeaker array elements forming said loudspeaker array are connected by said rigging components.

27. The loudspeaker array according to claim 26 wherein said loudspeaker array modules are arranged as a vertical line array.

* * * * *